US010662674B2

(12) United States Patent
Ho

(10) Patent No.: US 10,662,674 B2
(45) Date of Patent: May 26, 2020

(54) STRUCTURES OF ELECTRONIC LOCK

(71) Applicant: REAL LOCKS & SECURITY CO., LTD., New Taipei (TW)

(72) Inventor: Hsi-Hao Ho, New Taipei (TW)

(73) Assignee: REAL LOCKS & SECURITY CO., LTD., New Taipei (TW)

( * ) Notice: Subject to any disclaimer, the term of this patent is extended or adjusted under 35 U.S.C. 154(b) by 245 days.

(21) Appl. No.: 15/836,573

(22) Filed: Dec. 8, 2017

(65) Prior Publication Data

US 2019/0178004 A1 Jun. 13, 2019

(51) Int. Cl.

| | |
|---|---|
| ***E05B 47/00*** | (2006.01) |
| ***E05B 47/06*** | (2006.01) |
| ***E05B 67/36*** | (2006.01) |
| ***E05B 67/22*** | (2006.01) |
| *E05B 15/04* | (2006.01) |

(52) U.S. Cl.

CPC ..... *E05B 47/0012* (2013.01); *E05B 47/0603* (2013.01); *E05B 67/22* (2013.01); *E05B 67/36* (2013.01); *E05B 2015/0496* (2013.01); *E05B 2047/0016* (2013.01); *E05B 2047/0024* (2013.01); *E05B 2047/0058* (2013.01); *E05B 2047/0072* (2013.01)

(58) Field of Classification Search

CPC .. E05B 47/0012; E05B 47/06; E05B 47/0603; E05B 2047/0016; E05B 2047/0024; E05B 2047/0058; E05B 2047/0073; E05B 67/22; E05B 67/24; E05B 67/36; E05B 67/38; E05B 67/383

See application file for complete search history.

(56) References Cited

U.S. PATENT DOCUMENTS

| | | | | |
|---|---|---|---|---|
| 3,820,360 A * | 6/1974 | Best | E05B 67/36 70/6 |
| 5,987,939 A * | 11/1999 | Pitisettakarn | E05B 67/36 70/33 |
| 6,761,051 B1 * | 7/2004 | Tsai | E05B 47/0012 70/257 |
| 6,766,671 B2 * | 7/2004 | Haczynski | E05B 67/36 70/23 |
| 7,290,415 B2 * | 11/2007 | Rosenberg | E05B 67/383 70/34 |
| 7,948,359 B2 * | 5/2011 | Marcelle | G07C 9/00182 340/5.64 |
| 8,496,276 B2 * | 7/2013 | Kaminsky, Jr. | B60J 5/00 292/216 |

(Continued)

*Primary Examiner* — Christopher J Boswell

(74) *Attorney, Agent, or Firm* — Chun-Ming Shih; HDLS IPR Services

(57) ABSTRACT

A driving assembly of an electronic lock includes a circuit board, a motor, and an actuating cam. The abutting plate has a stopper portion and an accommodating opening. The actuating cam rotate into the accommodating opening so as to drive the abutting plate moving back and forth in a straight line. A latch assembly includes a locking column, and a buckling slot is provided at an outer periphery of the locking column. The stopper group includes a tongue pillar, a first resilience component and a tongue bolt. The tongue pillar is inserted in the buckling slot. The abutting plate moves back and forth that makes the stop portion to selectively block the tongue bolt.

12 Claims, 12 Drawing Sheets

(56) References Cited

U.S. PATENT DOCUMENTS

| | | | | |
|---|---|---|---|---|
| 8,978,426 | B2 * | 3/2015 | Wang | E05B 67/36 70/14 |
| 2015/0225986 | A1 * | 8/2015 | Goldman | E05B 47/0012 70/20 |
| 2017/0268260 | A1 * | 9/2017 | McGinnis | E05B 67/063 |
| 2018/0075679 | A1 * | 3/2018 | Niroomand | E05B 67/36 |

* cited by examiner

STRUCTURES OF ELECTRONIC LOCK

BACKGROUND OF THE INVENTION

Field of the Invention

The present invention generally relates to lock structures and, more particular to, structures of electronic lock.

Description of Prior Art

In general, an electronic lock is driven by a motor. The motor drives a dead bolt performing a retractable movement, and the lock of a latch bolt is controlled by a blocking of the dead bolt so as to achieve switches of a door through the electronic lock.

However, the power of the operation of the motor comes from the battery. Because the power stored in the battery is limited, the frequency of battery replacement can be reduced if the power consumption is decreased. Therefore, if the motor drives mechanism components of light weights (smaller load), the power consumption of the motor will be decreased, and the frequency of battery replacement will be reduced as well.

In view of the above drawbacks, the Inventor proposes the present invention based on his expert knowledge and elaborate researches in order to solve the problems of prior art.

SUMMARY OF THE INVENTION

Accordingly, an object of the present invention is to provide structures of electronic lock, in which the motor drives the actuating cam for moving the abutting plate, and the clamping of the locking column is controlled by the tongue pillar through the blocking of the abutting plate; thus, the power consumption of the motor will be reduced, and the frequency of battery replacement will be reduced, too.

In order to achieve the object mentioned above, the present invention provides structures of electronic lock including a pair of lock faceplates with a lock hole separately, a driving assembly, an abutting plate, a latch assembly, and a stopper group. The driving assembly includes a circuit board, a motor electrically connected with the circuit board, and an actuating cam driven by the motor. The abutting plate has a stopper portion and an accommodating opening disposed corresponding to the actuating cam. The actuating cam rotates into the accommodating opening to drive the abutting plate moving back and forth in a straight line. The latch assembly includes a locking column being capable of being inserted in the lock hole, and a buckling slot is provided at an outer periphery of the locking column. The stopper group includes a tongue pillar, a first resilience component elastically pushing the tongue pillar, and a tongue bolt. The tongue pillar is inserted in the buckling slot through the pushing of the first resilience component; wherein, the abutting plate moves back and forth that makes the stop portion to selectively block the tongue bolt; the tongue pillar can be disengaged from the buckling slot through the tongue pillar blocked the tongue bolt and the elastic compression of the first resilience component so that the locking column can be moved out of the lock hole.

Compared to the prior art, the structures of electronic lock of the present invention utilizes the motor to drive the actuating cam for moving the abutting plate, and the clamping of the locking column is controlled by the tongue pillar through the blocking of the abutting plate for performing operations of unlock and lock of the electronic lock. Moreover, since the motor drives the actuation cam of a lighter weight (less loaded), a less power consumption is required. Thus, the power consumption of the motor will be reduced, and the frequency of battery replacement will be reduced, too.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE PREFERRED EMBODIMENTS

In cooperation with attached drawings, the technical contents and detailed description of the invention are described thereinafter according to a number of preferable embodiments, being not used to limit its executing scope. Any equivalent variation and modification made according to appended claims is all covered by the claims claimed by the present invention.

Figure 1:
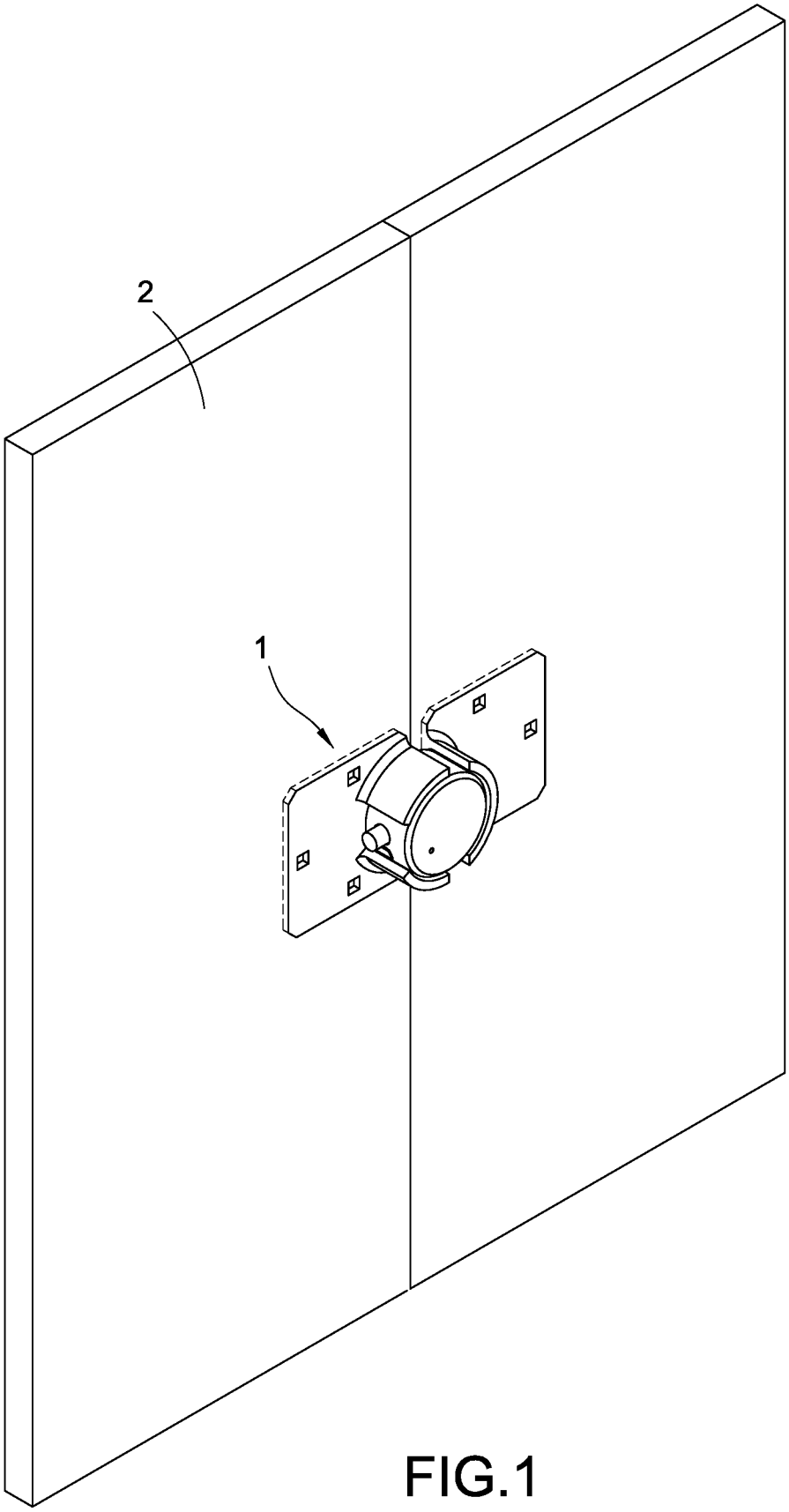
FIG. 1 is an application schematic view of structures of electronic lock of the present invention.

Please refer to FIG. 1, it depicts an application schematic view of structures of electronic lock of the present invention. The structures of electronic lock 1 of the present invention are installed on a door 2 for locking thereof. In real practice, the structures of electronic lock 1 can be applied to the items needed to be locked such as truck doors, cabinets, or general doors.

Figure 2:
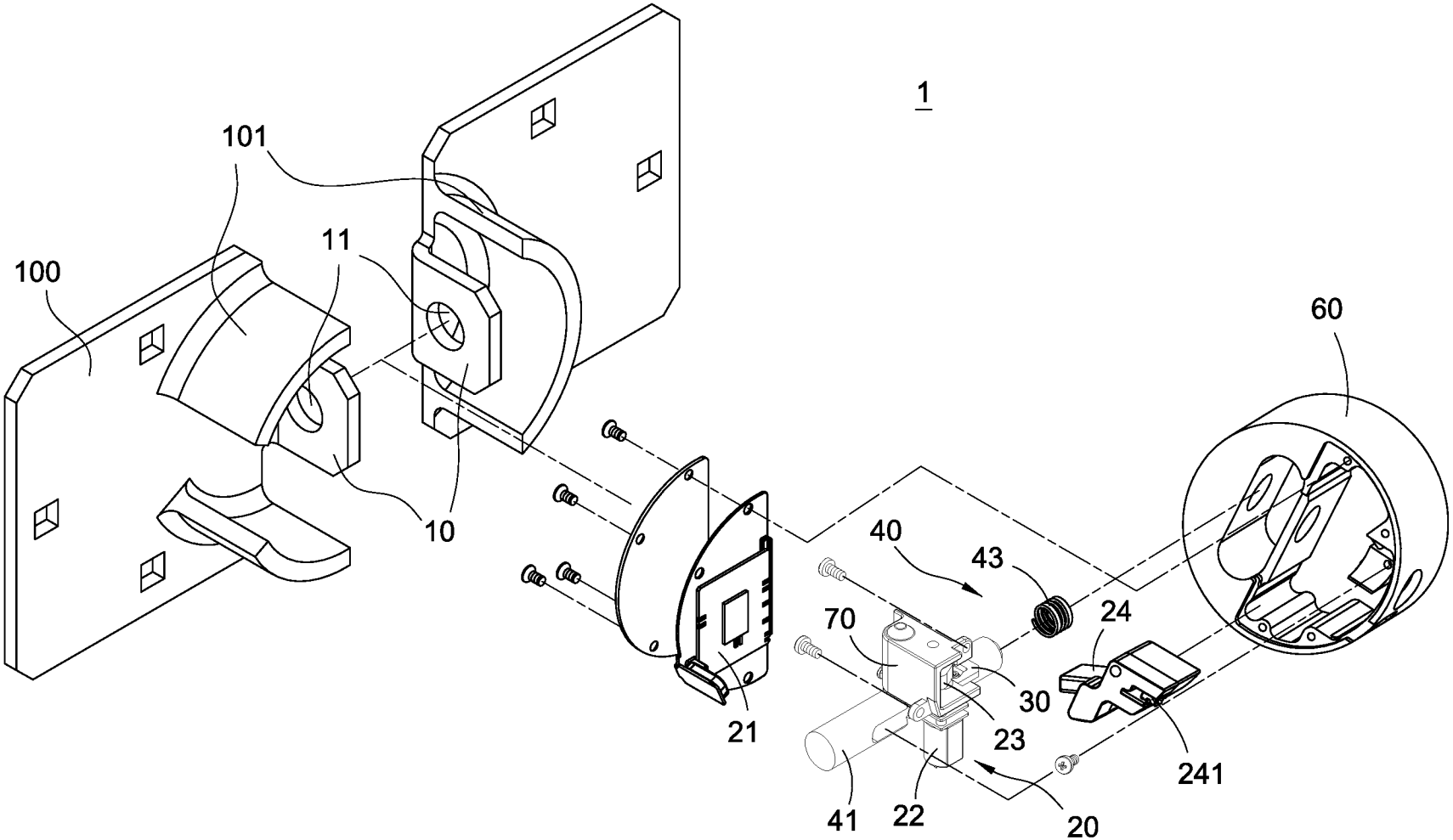
FIG. 2 is a perspective explosion schematic view of the electronic lock of the present invention.
Figure 3:
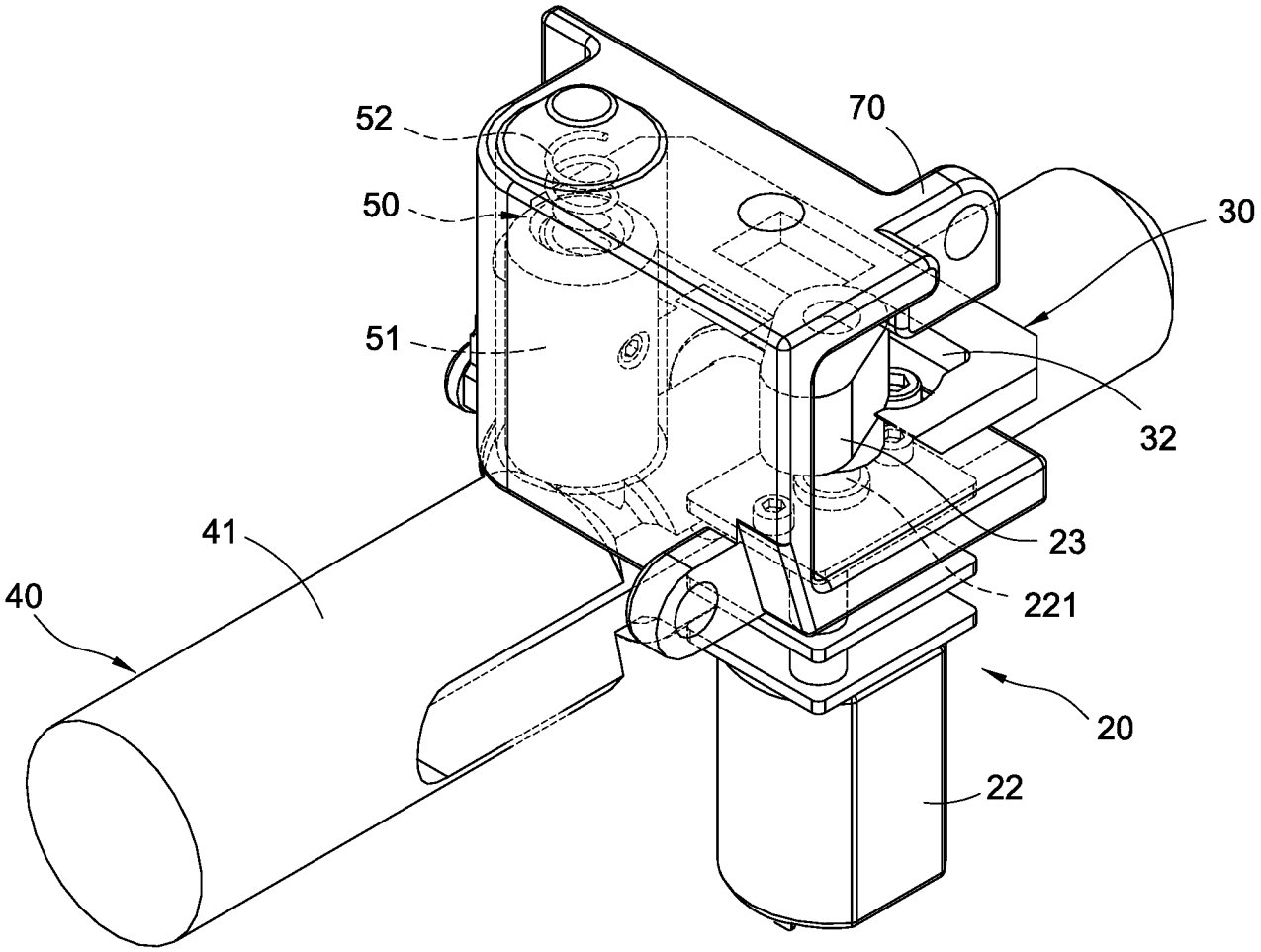
FIG. 3 is a perspective schematic view of internal control structures of the electronic lock of the present invention.

Please further refer to FIG. 2, it depicts a perspective explosion schematic view of the present invention. As shown in the figure, the structures of electronic lock 1 of the present invention include a pair of lock faceplates 10, a driving assembly 20, an abutting plate 30, a latch assembly 40 and a stopper group 50. The latch assembly 40 is used to lock the pair of lock faceplates 10. The driving assembly 20 drives the abutting plate 30 selectively pushing the stopper group 50 to control the stopper group 50 for blocking the latch assembly 40 so as to achieve the locking or unlocking actions of the pair of lock faceplates 10.

In one embodiment of the present invention, the driving assembly 20 includes a circuit board 21, a motor 22 electrically connected with the circuit board 21, and an actuating cam 23 driven by the motor 22. In addition, the driver assembly 20 further includes a battery 24 electrically connected with the circuit board 21. The battery has a power socket 241, and the power socket 241 is provided for plugging an external power plug to charge the battery 24.

Moreover, the structures of electronic lock 1 further includes a pair of doorplates 100. The pair of lock faceplates 10 are extended perpendicularly from the doorplates 100 correspondingly, and each of the lock faceplates 10 has a lock hole 11 on a side oppositely.

Preferably, the structures of electronic lock 1 further includes a lock shell 60. The pair of doorplates 100 are provided with an enclosing plate 101 corresponding to a configuration of the lock shell 60 separately; the lock shell 60 is inserted in the enclosing plates and covers the pair of the lock faceplates 10, the driver assembly 20, the abutting plate 30, the latch assembly 40, and the stopper group 50.

More in detail, the driver assembly 20, the abutting plate 30, the latch assembly 40, and the stopper group 50 can be assembled in the lock shell 60; thus, the lock shell 60 together with control mechanisms provided in the lock shell 60 can be separated integrally from the pair of doorplates 100 when the latch assembly 40 is detached from the pair of lock faceplates 10.

Please further refer to FIG. 3 to FIG. 6, they depict two perspective schematic views of internal control structures of the electronic lock of the present invention, a perspective explosion schematic view of the electronic lock of the present invention, and a cross sectional view of the electronic lock of the present invention. Please refer to FIG. 5, specifically, the actuating cam 23 has a sleeve 231; besides, the motor 22 has a shaft 221, and the sleeve 231 is sheathed on the shaft 221.

Moreover, the abutting plate 30 has a stopper portion 31 and an accommodating opening 32 disposed corresponding to the actuating cam 23; an inner wall of the accommodating opening 32 is disposed corresponding to an outline of the actuating cam 23. Therefore, the actuating cam 23 rotates into the accommodating opening 32 to drive the abutting plate 30 moving back and forth in a straight line. In addition, the stopper portion 31 is located at a side of the accommodating opening 32, and the abutting plate 30 has a hollow portion 33 at a side of the stopper portion 31.

Furthermore, the latch assembly includes a locking column 41 being capable of inserting in the lock hole 11 of the lock faceplate 10, and a buckling slot 42 is provided at an outer periphery of the locking column 41. Besides, the stopper group 50 includes a tongue pillar 51, a first resilience component 52 elastically pushing the tongue pillar 51, and a tongue bolt 53 being capable of elastically stretching out the tongue pillar 51, wherein the tongue pillar 51 is inserted in the buckling slot 42 through the pushing of the first resilience component 52. Preferably, the first resilience component 52 is a compression spring.

Preferably, the structures of electronic lock 1 further includes a supporting seat 70. The supporting seat 70 has formed with an accommodating hole 71 and a notch 72 located at a side of the accommodating opening 71. Moreover, the accommodating opening 71 is received with the first resilience component 52 and the tongue pillar 51, and the abutting plate 30 is disposed in the notch 72.

More in detail, the supporting seat 70 has a supporting plate 73 formed at a side of the notch 72. The actuating cam 23 is installed in the supporting seat 70 and located at an inner side of the supporting plate 73. The motor 22 is located at an outer side of the supporting plate 73 corresponding to the actuating cam 23.

Figure 4:
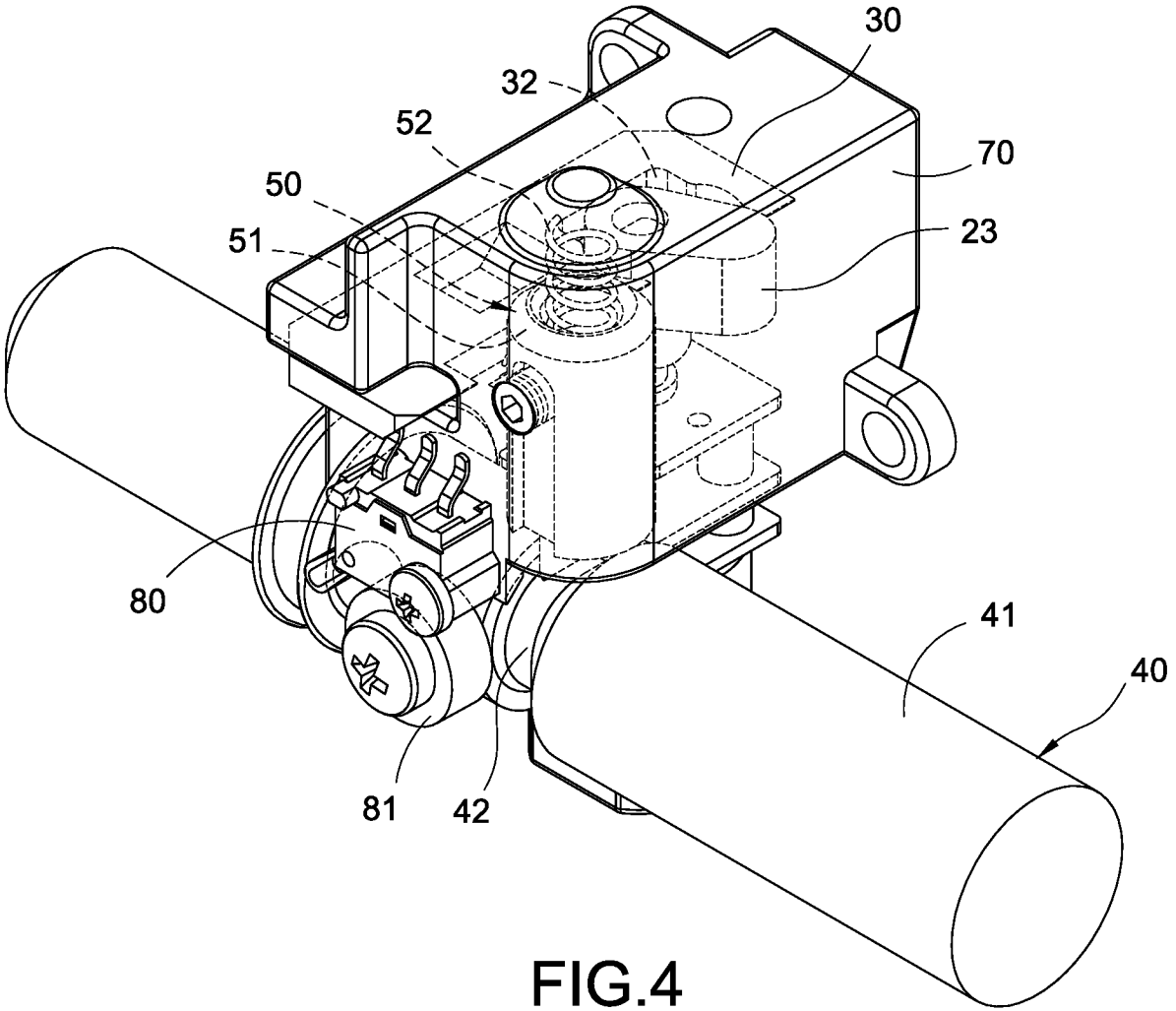
FIG. 4 is another perspective schematic view of internal control structures of the electronic lock of the present invention.
Figure 5:
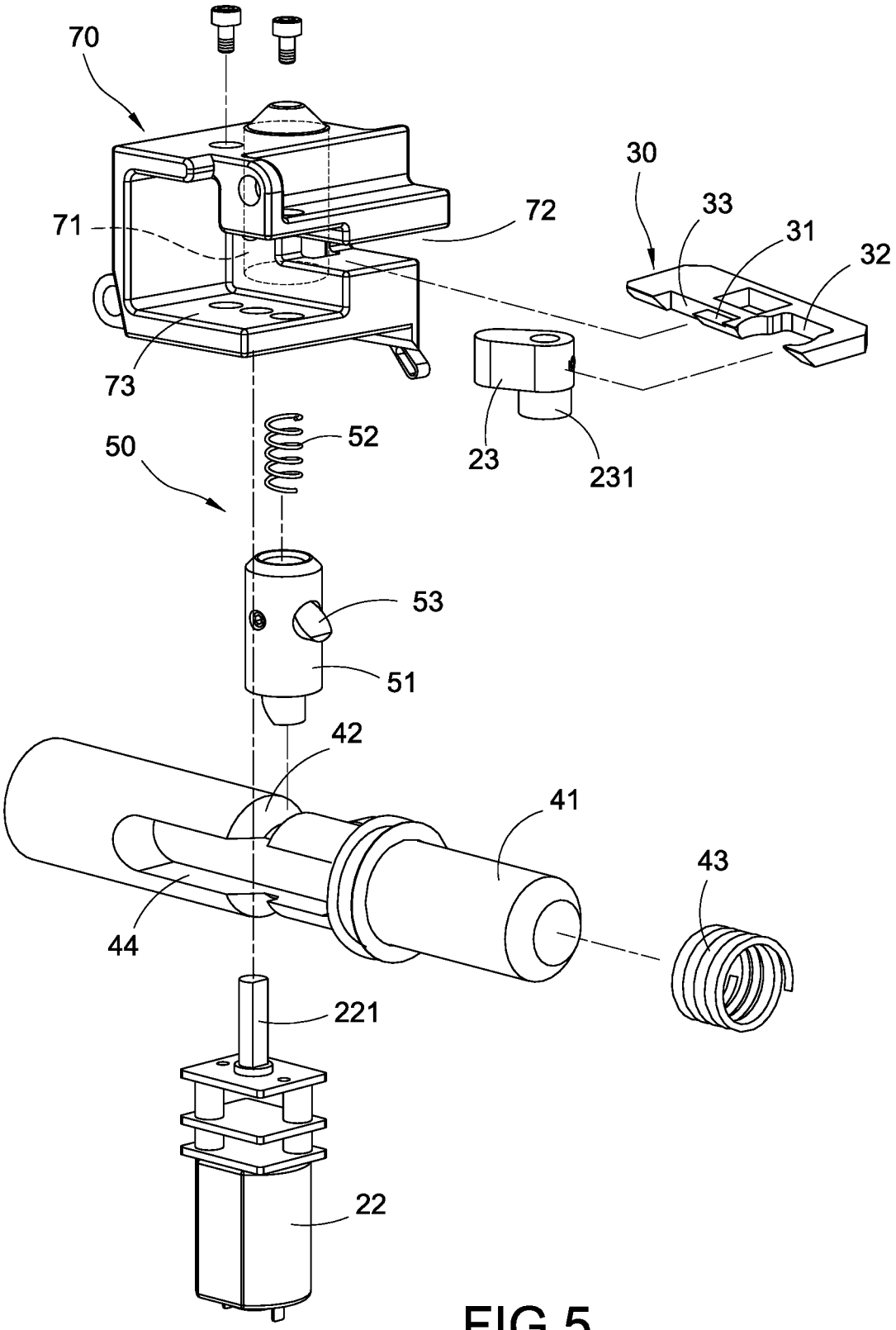
FIG. 5 is a perspective explosion schematic view of internal control structures of the electronic lock of the present invention.

It is worth noting that, please refer to FIG. 4 and FIG. 5, in one embodiment of present invention, the structures of electronic lock 1 further includes an actuation switch 80 and a toggle component 81 disposed on the locking column 41. Besides, the locking column 41 further includes a sliding slot 44 communicated with the buckling slot 42. Thus, the tongue pillar 51 slides into the sliding slot 42 by an external force pushing the locking column 41 so that the locking column 41 moves along a path which the tongue pillar 51 moves in the sliding slot 42 and drives the toggle element 81 touching the actuation switch 80. Therefore, the actuation switch 80 can transmit a touch signal to the circuit board 21 so that the circuit board 21 will command the motor to start operating.

Figure 6:
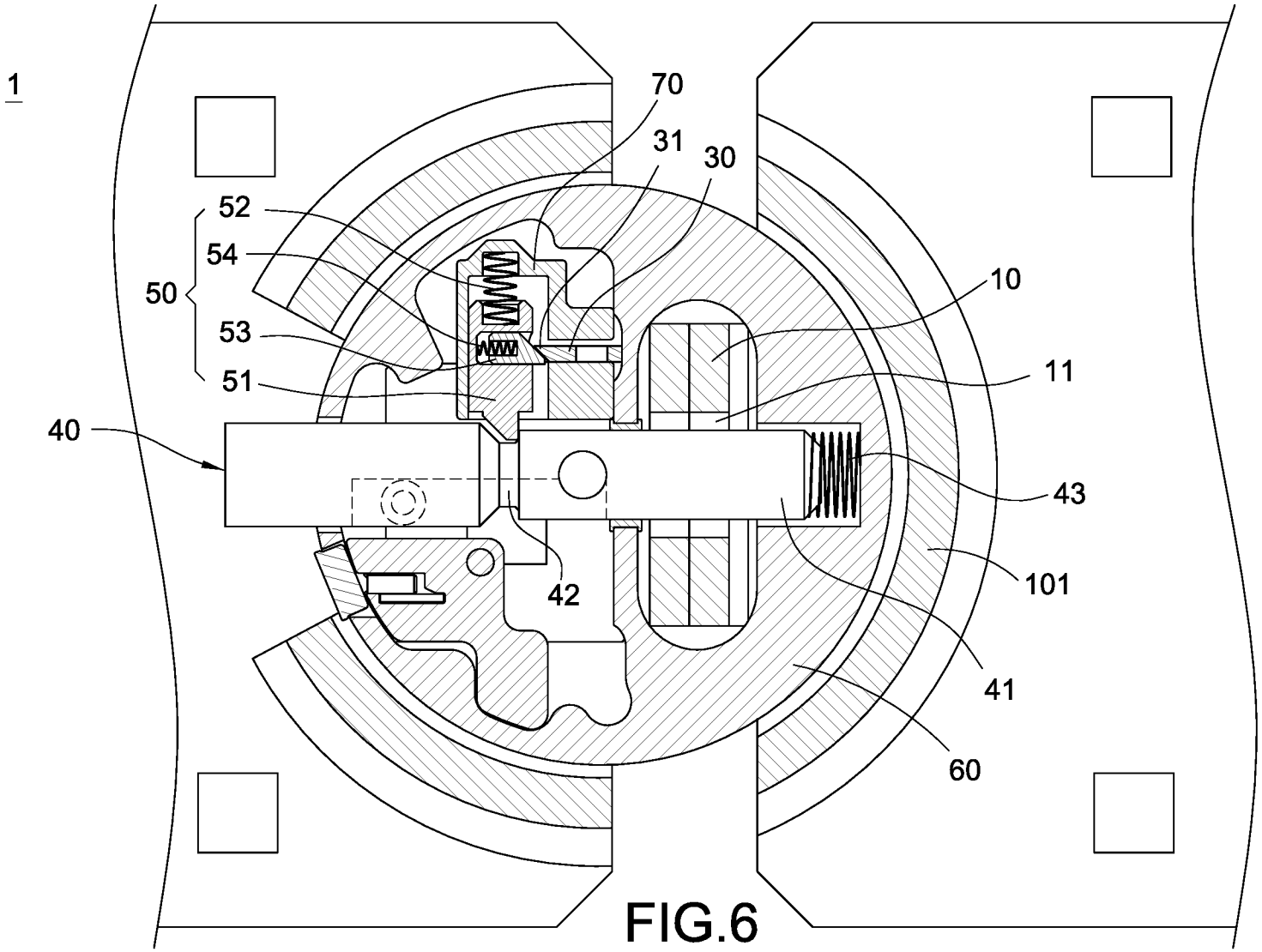
FIG. 6 is a cross sectional schematic view of internal control structures of the electronic lock of FIG. 7 is an unlock schematic view of structures of electronic lock of the present invention.

The latch assembly 40 further includes a second resilience component 43 elastically pushing the locking column 41; preferably, the second resilience component 43 is a compression spring. As shown in FIG. 6, the second resilience component 43 having elastic restoring force is disposed between the locking column 41 and the lock shell 60. One end of the locking column 41 abuts the second resilience element 43 and the other end protrudes out the lock shell 60. Furthermore, the stopper group 50 further includes a third resilience component 54. The third resilience component is disposed in the tongue pillar 51 and elastically pushes the tongue bolt 53, and the tongue bolt 53 can be protruded out or retracted into the tongue pillar 51 through the elastic force of the third elastic element 54; preferably, the third resilience component 54 is a compression spring.

Therefore, the abutting plate 30 moves back and forth that makes the stopper portion 31 to selectively block the tongue bolt 53. The tongue pillar 51 can be disengaged from the buckling slot 42 through a blocking of the tongue bolt 53 and an elastic compression of the first resilience component 52 so that the locking column 41 can be moved out of the lock hole 11 of the pair of the lock faceplates 10 for performing an operation of unlock. That is, the abutting plate 30 is moved back and forth so that the tongue bolt 53 is selectively located at the stopper portion 31 or the hollow portion 33. The tongue bolt 53 is located at the hollow portion 33 so that the tongue pillar 51 is inserted in the buckling slot 42 through the pushing of the first resilience component 52. At this moment, the locking column 41 cannot be moved out of the lock hole 11 of the pair of door faceplates 10 in a locking status.

Figure 7:
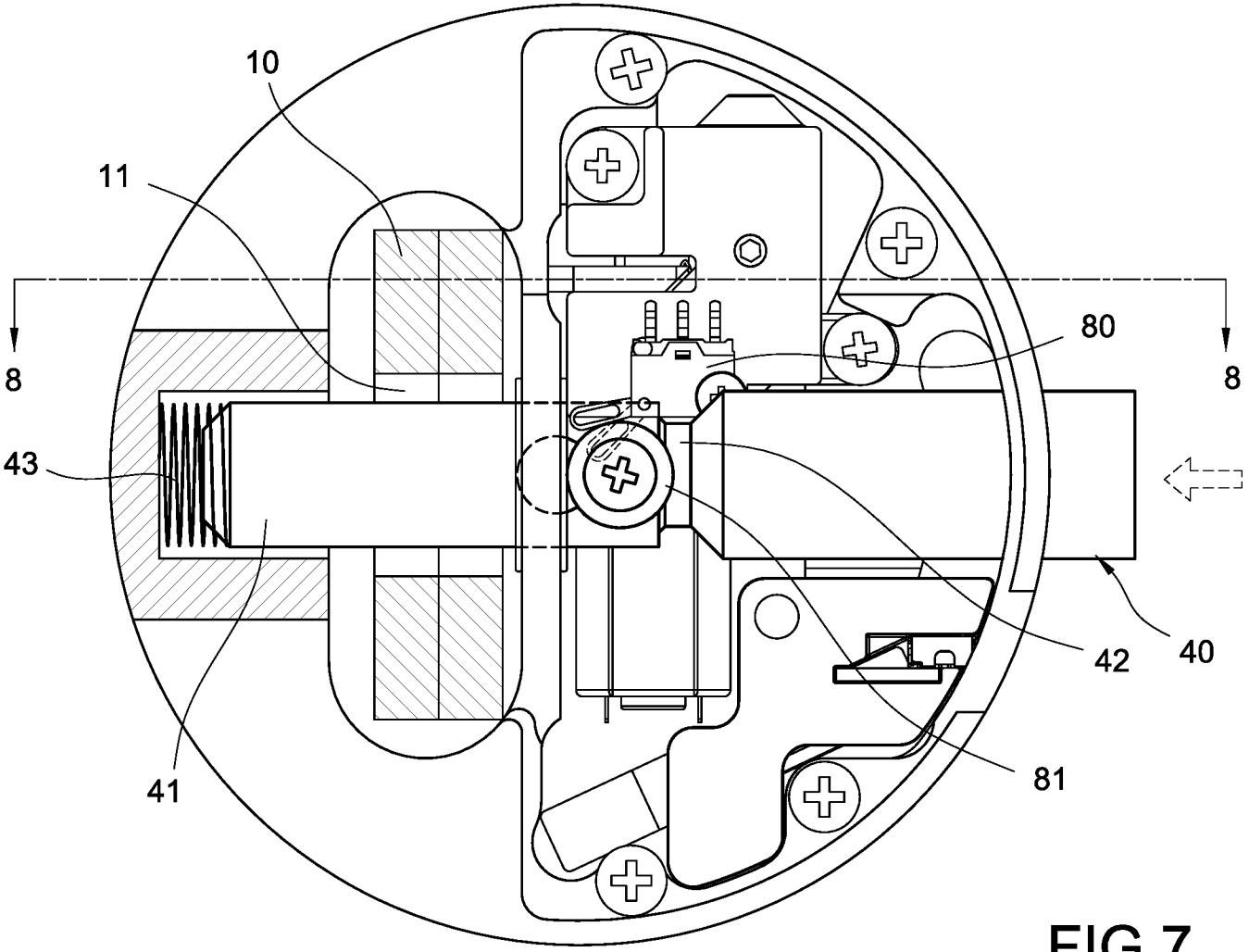
Figure 8:
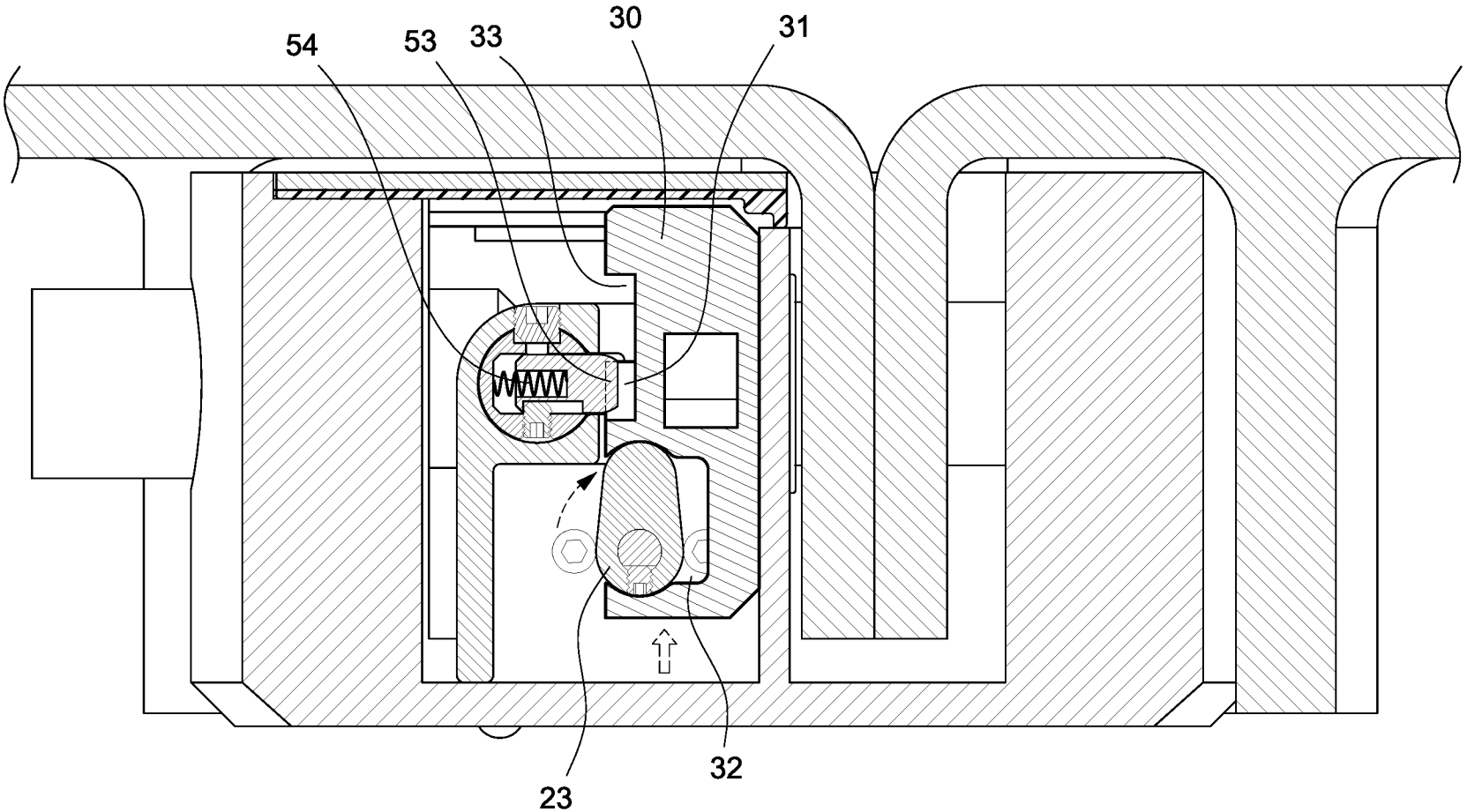
FIG. 8 is another unlock schematic view of structures of electronic lock of the present invention.
Figure 9:
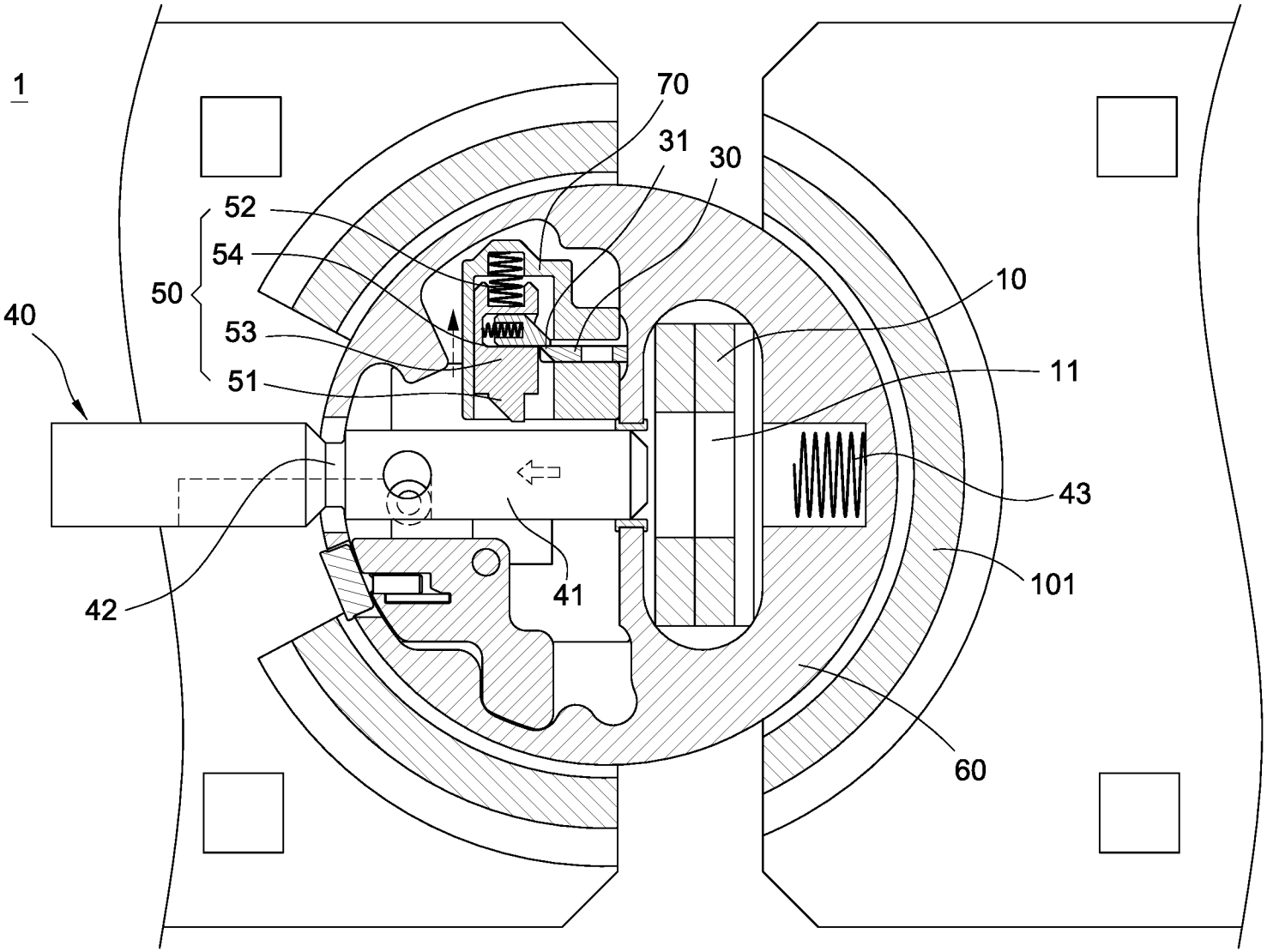
FIG. 9 is a further unlock schematic view of structures of electronic lock of the present invention.

Please further refer to FIG. 7 to FIG. 9, they depict unlock schematic views of the structures of electronic lock of the present invention. In the present invention, the driving assembly 20 needs to be operated firstly to unlock the structures of electronic lock for driving the abutting plate 30 blocking the stopper group 50 and releasing the clamping of the latch assembly 40 so that the locking column 41 can be moved from the lock hole 11 of the lock faceplates 10.

As shown in FIG. 7, when the locking column 41 is pushed by an external force (along a path which the tongue pillar 51 moves in the sliding slot 44), the locking column 41 moves and takes the toggle element 81 toggling the actuation switch 80. The actuation switch 80 can transmit a touch signal to the circuit board 21, so that the circuit board 21 commands the motor to start operating.

Please also refer to FIG. 8, the motor 22 drives the actuating cam 23 rotating, and the actuating cam 23 will rotate into a side of the accommodating opening 32 so as to drive the abutting plate 30 moving back and forth in a straight line. The abutting plate 30 moves in a direction toward the tongue pillar 51 until the stopper portion 31 is located at the bottom of the tongue bolt 53 (the tongue bolt 53 stops above the stopper portion 31) so as to press the tongue pillar 51.

As shown in FIG. 9, the tongue pillar 51 can be moved in a direction away from the buckling slot 42 through the elastic compression of the first elastic element 51. Thereby, the end of the tongue pillar 51 moves out of the buckling slot 42, and the locking column 41 can be moved out of the lock hole 11 to complete the operation of unlock when the locking column 41 is not blocked by the tongue pillar 51.

Figure 10:
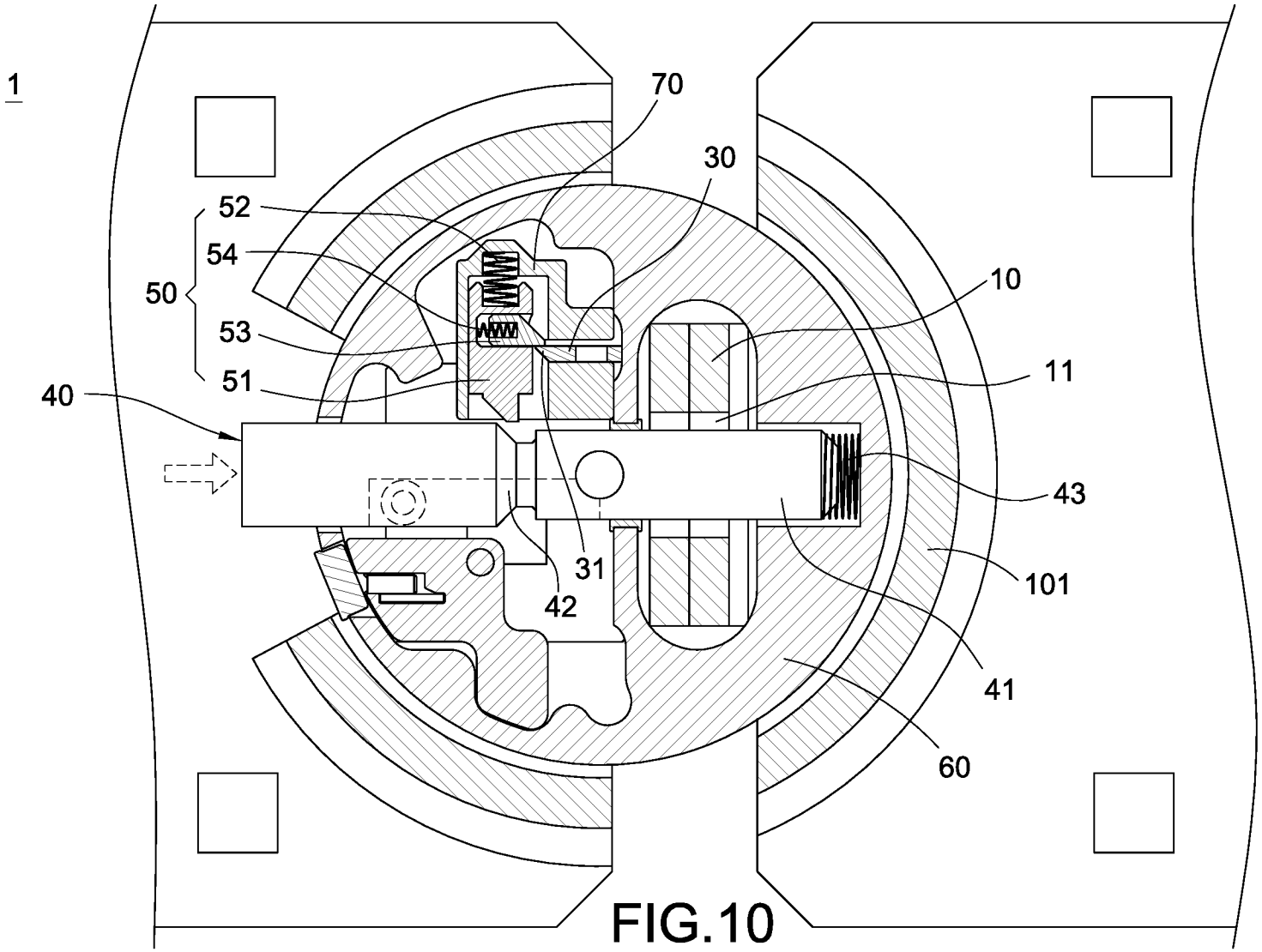
FIG. 10 is a lock schematic view of structures of electronic lock of the present invention.
Figure 11:
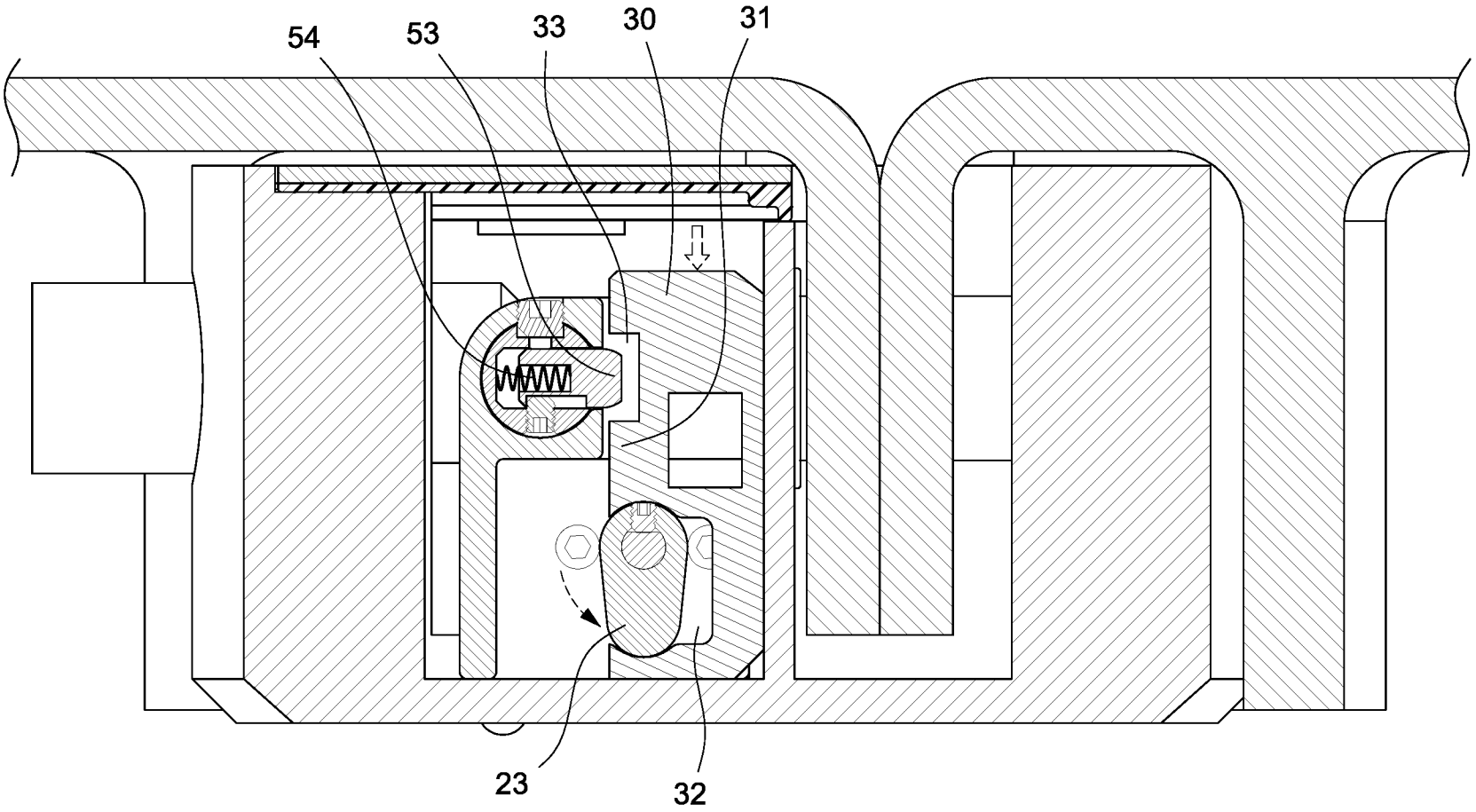
FIG. 11 is another lock schematic view of structures of electronic lock of the present invention.
Figure 12:
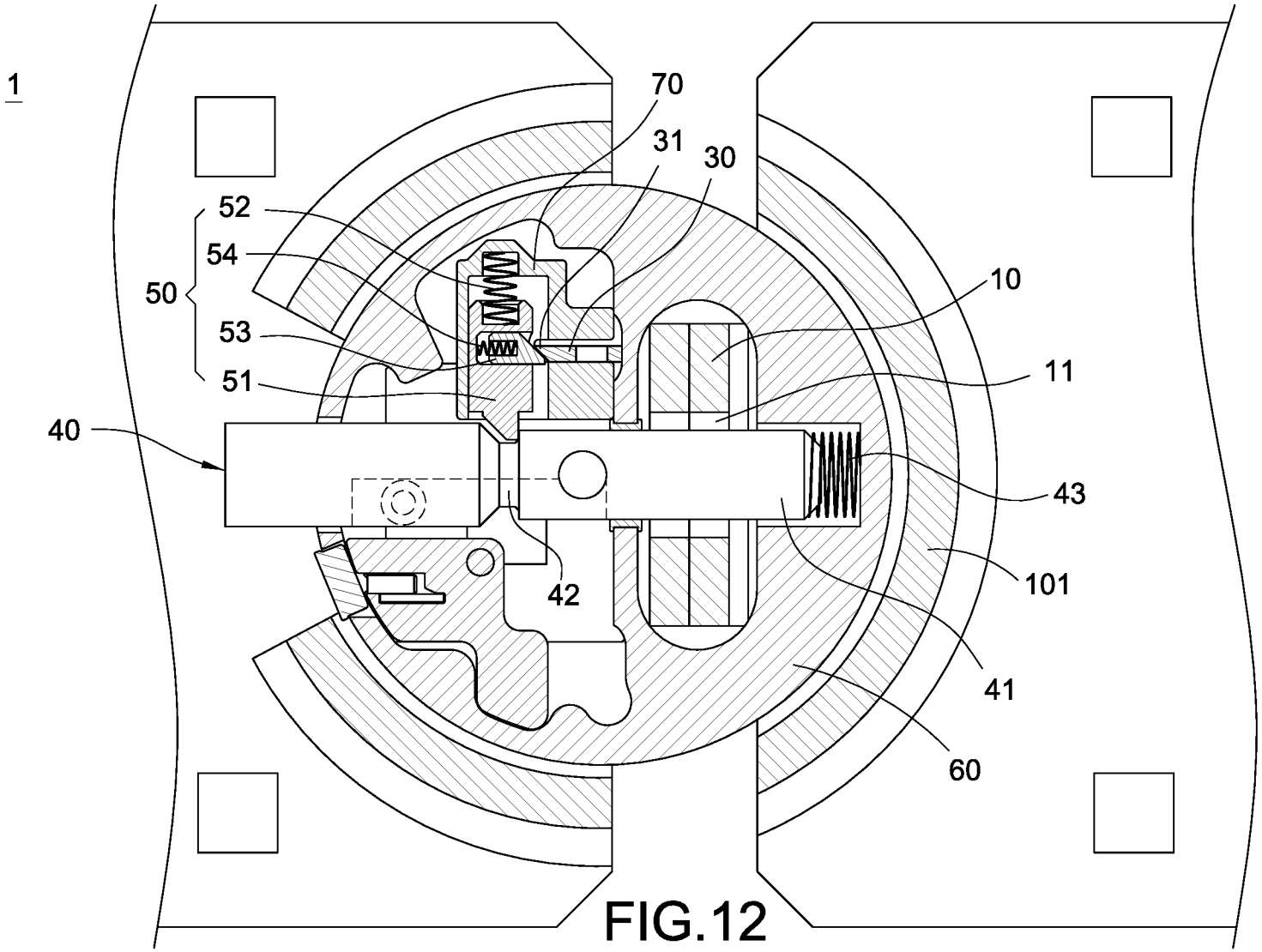
FIG. 12 is a further lock schematic view of structures of electronic lock of the present invention.

Please also refer to FIG. 10 to FIG. 12, they depict lock schematic views of the structures of electronic lock of the present invention. Similarly, in the present invention, the driving assembly 20 needs to be operated firstly to lock the structures of electronic lock for driving the abutting plate 30 to release the blocking of the stopper group 50 so that the end of the tongue pillar 51 can be inserted in the buckling slot 42 of the locking column 41.

As shown in FIG. 10, on the other hand, the locking column 41 will be pushed into the lock hole 11 again when the structures of electronic lock 1 needs to be locked. At this moment, the locking column 41 moves and takes the toggle element 81 touching the actuation switch 80 again. The actuation switch 80 will transmit a touch signal to the circuit board 21 so that the circuit board 21 commands the motor 22 to start operating.

With referring to FIG. 11, the motor 22 drives the actuating cam 23 rotating, and the actuating cam 23 will rotate into another side of the accommodating opening 32 so as to take the abutting plate 30 moving in a direction toward the tongue pillar 51 until the hollow portion 33 is located at the position of the tongue bolt 53.

As shown in FIG. 12, the tongue pillar 51 can be moved in a direction toward the buckling slot 42 through the elastic restoring force of the first resilience element 52. Thus, the end of the tongue pillar 51 will be inserted in the buckling slot 42 of the locking column 41 again, and the locking column 41 will be blocked by the tongue pillar 51 again so that the locking column 41 cannot be moved out of the lock hole 11 to complete the operation of lock.

Although the present invention has been described with reference to the preferred embodiment thereof, it will be understood that the invention is not limited to the details thereof. Various substitutions and improvements have been suggested in the foregoing description, and others will occur to those of ordinary skill in the art. Therefore, all such substitutions and improvements are intended to be embraced within the scope of the invention as defined in the appended claims.

What is claimed is:

1. Structures of electronic lock, including:

a pair of lock faceplates, each of the lock faceplates having a lock hole on a side oppositely;

a driving assembly, including a circuit board, a motor electrically connected with the circuit board, and an actuating cam driven by the motor;

an abutting plate, having a stopper portion and an accommodating opening disposed corresponding to the actuating cam; the actuating cam rotating into the accommodating opening to drive the abutting plate moving back and forth in a straight line;

a latch assembly, including a locking column being capable of being inserted in the lock hole; a buckling slot is provided at an outer periphery of the locking column; and a stopper group, including a tongue pillar, a first resilience component elastically pushing the tongue pillar, and a tongue bolt being capable of elastically stretching out the tongue pillar, and the tongue pillar being inserted in the buckling slot through the pushing of the first resilience component;

wherein, the abutting plate moves back and forth to make the stopper portion selectively block the tongue bolt; the tongue pillar can be disengaged from the buckling slot through a blocking of the tongue bolt and an elastic compression of the first resilience component so that the locking column can be moved out of the lock hole; and wherein the actuating cam is driven by the motor to rotate inside the accommodating opening to push the abutting plate to slide in a direction perpendicular to an axial direction of the actuating cam.

2. The structures of electronic lock according to claim 1, further including a pair of doorplates, wherein the pair of lock faceplates are extended perpendicularly from the doorplates correspondingly.

3. The structures of electronic lock according to claim 2, further including a lock shell, wherein the pair of doorplates are provided with two enclosing plates corresponding to a configuration of the lock shell respectively; the lock shell is inserted in the enclosing plates and covers the pair of the lock faceplates, the driver assembly, the abutting plate, the latch assembly, and the stopper group.

4. The structures of electronic lock according to claim 3, wherein the latch assembly further includes a second resilience component elastically pushing the locking column; the second resilience component having elastic restoring force is disposed between the locking column and the lock shell; one end of the locking column abuts the second resilience element and the other end protrudes out the lock shell.

5. The structures of electronic lock according to claim 3, wherein the driving assembly, the abutting plate, the latch assembly, and the stopper group are assembled in the lock shell and can be detached integrally when the locking column is detached from the pair of the lock faceplates.

6. The structures of electronic lock according to claim 1, wherein the actuating cam has a sleeve; the motor has a shaft, and the sleeve is sheathed on the shaft.

7. The structures of electronic lock according to claim 1, further including a supporting seat, wherein the supporting seat has formed with an accommodating hole and a notch located at a side of the accommodating hole; the accommodating hole accommodates the first resilience component and the tongue pillar, and the abutting plate is disposed in the notch.

8. The structures of electronic lock according to claim 7, wherein the supporting seat has a supporting plate formed at a side of the notch; the actuating cam is installed in the supporting seat and located in an inner side of the supporting plate, and the motor is located in an outer side of the supporting plate corresponding to the actuating cam.

9. The structures of electronic lock according to claim 1, wherein the stopper portion is located at a side of the accommodating opening; the abutting plate has a hollow portion provided at a side of the stopper portion; the abutting plate is moved back and forth so that the tongue bolt is selectively located at the stopper portion or the hollow portion, and the tongue bolt is located in the hollow portion so that the tongue pillar is inserted in the buckling slot through the pushing of the first resilience component.

10. The structures of electronic lock according to claim 1, wherein the driver assembly further includes a battery electrically connected to the circuit board, and the battery has a power socket.

11. The structures of electronic lock according to claim 1, further including an actuation switch and a toggle component disposed on the locking column, wherein the locking column further includes a sliding slot communicated with the buckling slot, and the tongue pillar slides into the sliding slot when the locking column is pushed by an external force so that the locking column is able to move and drive the toggle element touching the actuation switch.

12. The structures of electronic lock according to claim 1, wherein the stopper group further includes a third resilience component; the third resilience component is disposed in the tongue pillar and elastically pushes the tongue bolt, and the tongue bolt can be protruded out or retracted into the tongue pillar through the elastic force of the third resilience element.

* * * * *